US008857254B2

(12) United States Patent
Wilson

(10) Patent No.: US 8,857,254 B2
(45) Date of Patent: Oct. 14, 2014

(54) METHODS AND SYSTEMS FOR ACQUIRING ACCELERATION WAVEFORMS IN A BOREHOLE

(75) Inventor: Colin A. Wilson, Tolworth (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 400 days.

(21) Appl. No.: 13/311,557

(22) Filed: Dec. 6, 2011

(65) Prior Publication Data

US 2012/0152013 A1 Jun. 21, 2012

Related U.S. Application Data

(60) Provisional application No. 61/424,679, filed on Dec. 20, 2010.

(51) Int. Cl.
*E21B 47/00* (2012.01)
*E21B 47/022* (2012.01)

(52) U.S. Cl.
CPC ..... *E21B 47/02208* (2013.01)
USPC ..... 73/152.54

(58) Field of Classification Search
USPC ..... 73/152.54
See application file for complete search history.

(56) References Cited

U.S. PATENT DOCUMENTS 6,630,890 B1 10/2003 Endo et al.
2011/0056750 A1* 3/2011 Lucon ..... 175/56

* cited by examiner

*Primary Examiner* — Hezron E Williams
*Assistant Examiner* — Rodney T Frank
(74) *Attorney, Agent, or Firm* — Daryl R. Wright; Jody DeStefanis

(57) ABSTRACT

Methods and apparatus for acquiring acceleration waveform measurements while deploying a tool along a borehole. A conveyance and a sensor section are configured to deploy the sensor section in the borehole. At least one multi-axis receiver is configured to detect acceleration waveform signals while the sensor section is being deployed in the borehole.

20 Claims, 7 Drawing Sheets

METHODS AND SYSTEMS FOR ACQUIRING ACCELERATION WAVEFORMS IN A BOREHOLE

RELATED APPLICATIONS

This application claims priority of U.S. Provisional Patent Application Ser. No. 61/424,679, filed 20 Dec. 2010, the entire contents of which are incorporated herein by reference for all purposes.

BACKGROUND

1. General Technical Field

The present disclosure relates generally to methods and systems for performing borehole seismic surveys relating to subterranean formations. More specifically, some aspects disclosed herein are directed to methods and systems for acquiring and processing waveform measurements in a borehole for characterizing subterranean formations having oil and/or gas deposits therein. The borehole measurements include accelerometer data that are acquired during deployment of a receiver array to derive, for example, tool orientation and position and well profile information.

2. Description of the Related Art

The following descriptions and examples are not admitted to be prior art by virtue of their inclusion in this section.

Logging and monitoring boreholes has been done for many years to enhance and observe recovery of oil and gas deposits. In the logging of boreholes, one method of making measurements underground includes attaching one or more tools to a wireline connected to a surface system. The tools are then lowered into a borehole by the wireline and drawn back to the surface ("logged") through the borehole while taking measurements. The wireline is usually an electrical conducting cable with data transmission capability.

Seismic exploration can provide valuable information useful in, for example, the drilling and operation of oil and gas wells. Seismic measurements of the type described herein may also be used for a wide variety of purposes that are known in the fields of passive and active seismic monitoring. In seismic exploration, energy is introduced by a seismic source, for example, an active or a passive source of seismic energy, to create a seismic signal that propagates through the subterranean formation. This seismic signal is modified to differing degrees by features that are of interest. A receiver acquires the seismic signals to help generate a seismic map of the underground features. As a practical matter, the system may comprise a plurality of sources and receivers to provide a comprehensive map of subterranean features. Different configurations may yield two dimensional or three dimensional results depending on their mode of operation.

A vertical seismic profile (VSP) is a class of borehole seismic measurements used for correlation between surface seismic receivers and wireline logging data. VSPs can be used to tie surface seismic data to well data, providing a useful tie to measured depths. Typically VSPs yield higher resolution data than surface seismic profiles provide. VSPs enable converting seismic data to zero-phase data as well as enable distinguishing primary reflections from multiples. In addition, a VSP is often used for analysis of portions of a formation ahead of the drill bit.

Narrowly defined, VSP refers to measurements made in a vertical wellbore using acoustic receivers inside the wellbore and a seismic source at the surface near the well. In a more general context as used herein, however, VSPs vary in well configuration, the number and location of sources and acoustic receivers, and how they are deployed. Nevertheless, VSP does connote the deployment of at least some receivers in the wellbore. Most VSPs use a surface seismic source, which is commonly a vibrator on land, or an airgun, marine vibrator, watergun, or other in-sea seismic source in marine environments.

There are various VSP configurations including zero-offset VSP, offset VSP, walkaway VSP, vertical incidence VSP, salt-proximity VSP, multi-offset VSP, and drill-noise or seismic-while-drilling VSP. Checkshot surveys are similar to VSP in that acoustic receivers are placed in the borehole and a surface source is used to generate an acoustic signal. However, a VSP is a more detailed than a checkshot survey. The VSP receivers are typically more closely spaced than those in a checkshot survey; checkshot surveys may include measurement intervals hundreds of meters apart. Further, a VSP uses the reflected energy contained in the recorded trace at each receiver position as well as the first direct path from source to receiver while the checkshot survey uses only the direct path travel time.

Microseismic events, also known as micro-earthquakes, may be produced during hydrocarbon and geothermal fluid production operations. Typically microseismic events are caused by shear-stress release on pre-existing geological structures, such as faults and fractures, due to production/injection induced perturbations to the local earth stress conditions. In some instances, microseismic events may be caused by rock failure through collapse, i.e., compaction, or through hydraulic fracturing. Such induced microseismic events may be induced or triggered by changes in the reservoir, such as depletion, flooding or stimulation, in other words the extraction or injection of fluids. The signals from microseismic events can be detected in the form of elastic waves transmitted from the event location to remote sensors. The recorded signals contain valuable information on the physical processes taking place within a reservoir.

Various microseismic monitoring techniques are known, and it is also known to use microseismic signals to monitor hydraulic fracturing and waste re-injection. The seismic signals from these microseismic events can be detected and located in space using high bandwidth borehole sensors. Microseismic activity has been successfully detected and located in rocks ranging from unconsolidated sands, to chalks to crystalline rocks.

While VSPs and microseismic surveys can provide valuable information about a formation, it is necessary to derive the orientation and location of the seismic sensors that are deployed for acquiring measurement data. Knowing the receiver depths and positions and orientation of the sensors when the tool reaches its required acquisition position is a required parameter for the processing of seismic and microseismic data. The more accurately this position is determined, the better.

Positions of the receivers can be determined by comparing and correlating the length of the cable, or sensor signals down the well with a previously determined well profile, such as depth or Gamma Ray. Sometimes however, the well profile and depth are not well known and receiver positioning errors can be introduced, causing inaccurate mapping of seismic events.

The orientation of the multi-axis sensors in seismic and microseismic data acquisition is normally determined by firing a shot or producing an event at a known surface location or set of locations or at known depths in an adjacent monitor well. Note FIG. 7. The amplitude of arrival of the event at the multi-axis sensors is compared to the known location of the event. From this the orientation of the multi-axis sensors can be determined.

There is a need, however, for improving the currently available techniques for acquiring and processing such borehole measurements. The process of determining receiver orientations requires time and effort to produce the known shot locations. The time required to perform this process would be greatly reduced or even eliminated altogether if the orientation of the sensors were known during the deployment of the multi-axis receiver array. Furthermore, as discussed above, in some circumstances it is desirable to determine or confirm the well profile as the tools are deployed in the well.

The limitations of conventional borehole seismic techniques noted in the preceding are not intended to be exhaustive but rather are among many which may reduce the effectiveness of previously known borehole seismic methods and systems. The above should be sufficient, however, to demonstrate that borehole seismic techniques existing in the past will admit to worthwhile improvement.

SUMMARY OF THE DISCLOSURE

The disclosure herein may meet at least some of the above-described needs and others. In consequence of the background discussed above, and other factors that are known in the field of borehole seismic surveying, the applicant recognized the need for improved methods and systems for acquiring and processing borehole measurements for purposes of monitoring subterranean formations in a reliable, efficient manner. In this, the applicant recognized that techniques were needed that could eliminate, or at least reduce, shortcomings that are inherent in the conventional methods and systems for borehole seismic, in particular, Vertical Seismic Profile (VSP) and microseismic type surveys.

Some embodiments of the present disclosure provide improved techniques for deriving tool orientation and positioning by acquiring borehole accelerometer measurements during deployment of receiver arrays in a borehole. Other embodiments may additionally or alternatively determine the profile of a well by acquiring accelerometer measurements during deployment of receiver arrays in a borehole.

The applicant recognized that it is possible to determine the positioning and/or location of tools in the well or the well profile during deployment using, for example, multi-axis sensors such as provided in a highly sensitive multi-axis accelerometer tool. The multi-axis sensors may be configured to acquire accelerometer data while the tool is moving during deployment. Such data may be processed to derive the velocity and then tool position and well profile, for example, by double integrating the accelerometer data over time.

In certain embodiments, the present disclosure proposes efficient and reliable methods and systems for conducting borehole surveys. Some of the methods and systems disclosed herein are directed at the deployment of seismic mechanisms using technologies proposed herein to monitor key reservoir parameters in relation to the production of oil and/or gas.

In one aspect of the present disclosure, a system for acquiring accelerometer waveform data during deployment of a tool in a borehole comprises a conveyance and at least one sensor section configured for deployment of the sensor section in a borehole. The sensor section may include at least one multi-axis receiver configured to detect acceleration waveform signals while the sensor section is being deployed in the borehole.

The multi-axis sensors may also be configured in a sensor package of a tool such as Schlumberger's Versatile Seismic Imager ("VSI"). The sensor array may comprise combinations of three-component (3C) geophones or accelerometers as desirable or necessary based on the operational circumstances.

Additional advantages and novel features will be set forth in the description which follows or may be learned by those skilled in the art through reading the materials herein or practicing the principles described herein. Some of the advantages described herein may be achieved through the means recited in the attached claims.

BRIEF DESCRIPTION OF THE DRAWINGS

Certain embodiments of the present disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

Figure 1:
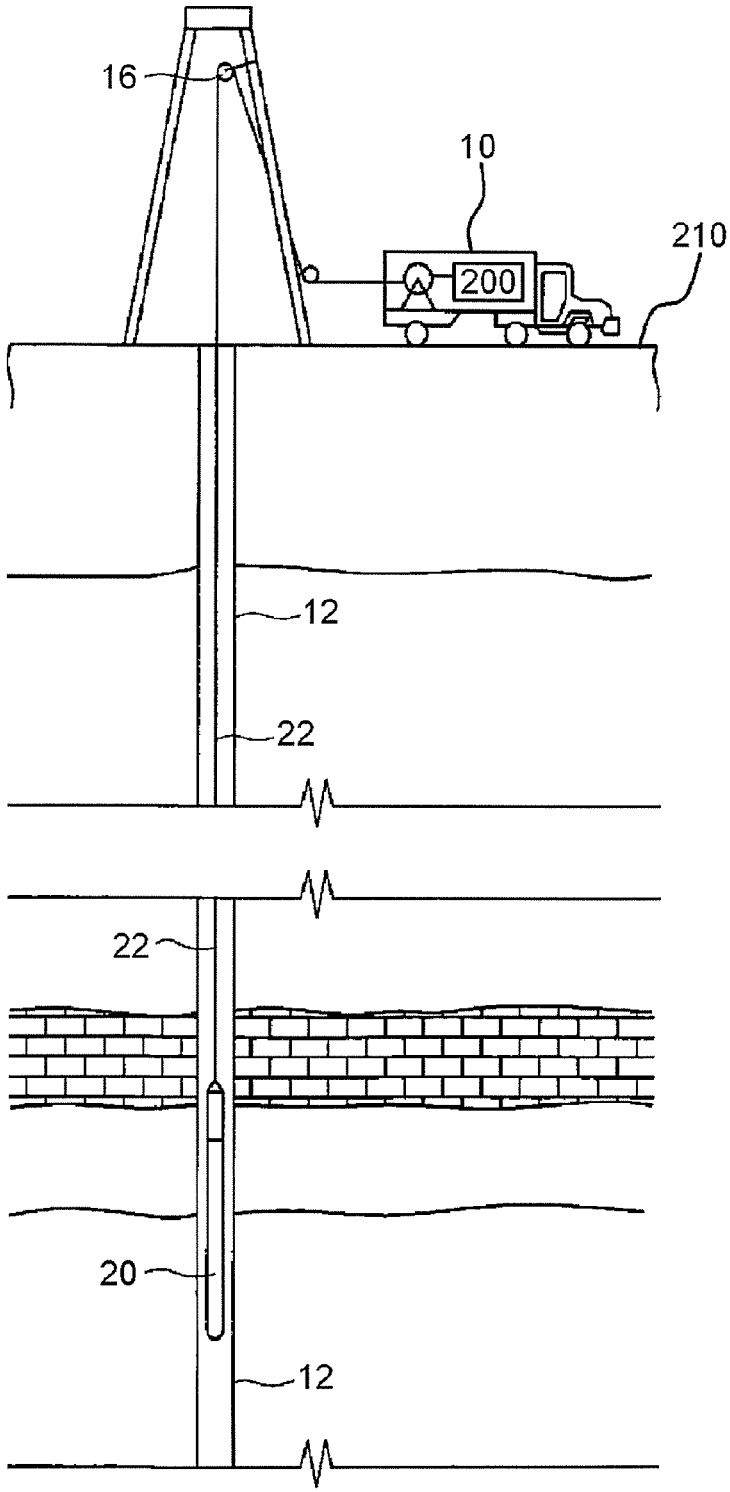
FIG. 1 shows one possible operational context for a downhole system in accordance with the disclosure herein.

Throughout the drawings, identical reference numbers and descriptions indicate similar, but not necessarily identical elements. While the principles described herein are susceptible to various modifications and alternative forms, specific embodiments have been shown by way of example in the drawings and will be described in detail herein. However, it should be understood that the subject matter of the present disclosure is not intended to be limited to the particular forms disclosed. Rather, the subject matter includes all modifications, equivalents and alternatives falling within the scope of the appended claims.

DETAILED DESCRIPTION

Illustrative embodiments and aspects of the present disclosure are described below. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this disclosure.

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, a permanent monitoring tool, and a combination tool.

Referring generally to FIG. 1, FIG. 1 is an exemplary embodiment of a system utilizing a downhole tool according to aspects of the present disclosure. While FIG. 1 depicts one possible setting for utilization of various embodiments, other operating environments also are contemplated by the present disclosure.

In FIG. 1, a service vehicle 10 is situated at the formation surface 210 of a wellsite having a borehole or wellbore 12 with a downhole tool 20 suspended in the borehole 12. The downhole tool 20 typically is suspended from the lower end of a cable 22 spooled via a winch or cable drum 16 at the formation surface 210. The downhole tool 20 may be used for borehole seismic surveying. The downhole tool 20 may also or alternatively be used to monitor fluid injection, formation fracturing, seismic mapping, and the like. Additionally, the downhole tool 20 may have functions to measure various parameters such as, for example, testing earth formations and analyzing the composition of fluids from a formation, flow rates, temperatures, pressures, fluid properties, gamma radiation properties, and the like.

The downhole tool 20 may be a wireline tool, a wireline logging tool, a downhole tool string, or other known means of deployment such as a drill collar, a sonde, a drill bit, a measurement-while-drilling tool, a logging-while-drilling tool, a permanent monitoring tool, and the like.

The cable 22 may be a multiconductor logging cable, wireline, or other means of conveyance and/or communication that are known to persons skilled in the art. The service vehicle 10 includes a surface system 200. The surface system 200 may have appropriate electronics control, processing systems and telemetry capability for the downhole tool 20. The cable 22 typically is electrically coupled to the surface system 200.

Figure 2:
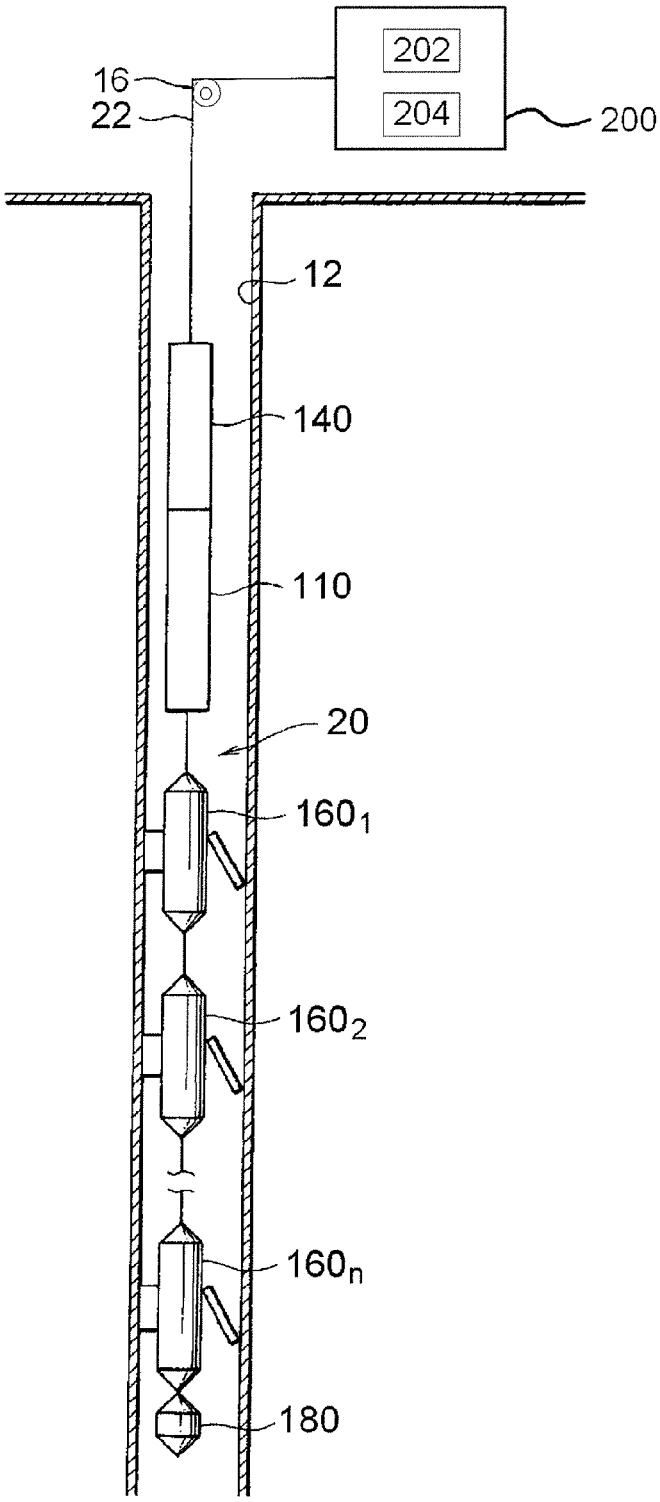
FIG. 2 shows one configuration for a downhole tool in accordance with the present disclosure.

FIG. 2 shows another possible embodiment of a surface control system 200 and downhole tool 20. In this embodiment, the surface system 200 includes a data communication unit 202 and a processing and control unit 204. The data communication unit 202 may include a control processor that outputs a control signal and is operatively connected with the downhole tool 20 via the cable or fiber 22 so that the control signal is delivered to the downhole tool 20. In this example, the downhole tool 20 includes a telemetry cartridge 140, an electronic cartridge 110 having, for example, an electrical tool bus, and an array of tool shuttles $\mathbf{160}_1$, $\mathbf{160}_2$, . . . , $\mathbf{160}_n$, and an array terminator 180 provided in this order from top to down in the borehole 12. The telemetry cartridge 140 communicates with the surface system 200. This structure is disclosed in commonly-owned U.S. Pat. No. 6,630,890, the contents of which are incorporated herein by reference in their entirety.

The downhole tool 20 of FIG. 2 may include a downhole sensing and data acquisition system placed in the electronic cartridge 110 and the array of tool shuttles $\mathbf{160}_1$, $\mathbf{160}_2$, . . . , $\mathbf{160}_n$. Methods described herein may be embodied in a computer program that runs in the processor 204. The computer program may be stored on a computer usable storage medium associated with the processor, or may be stored on an external computer usable storage medium and electronically coupled to the processor for use as needed. The storage medium may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein. In operation, the program is coupled to operative elements of the downhole tool 20 via the cable 22 in order to receive data and to transmit control signals.

Figure 7:
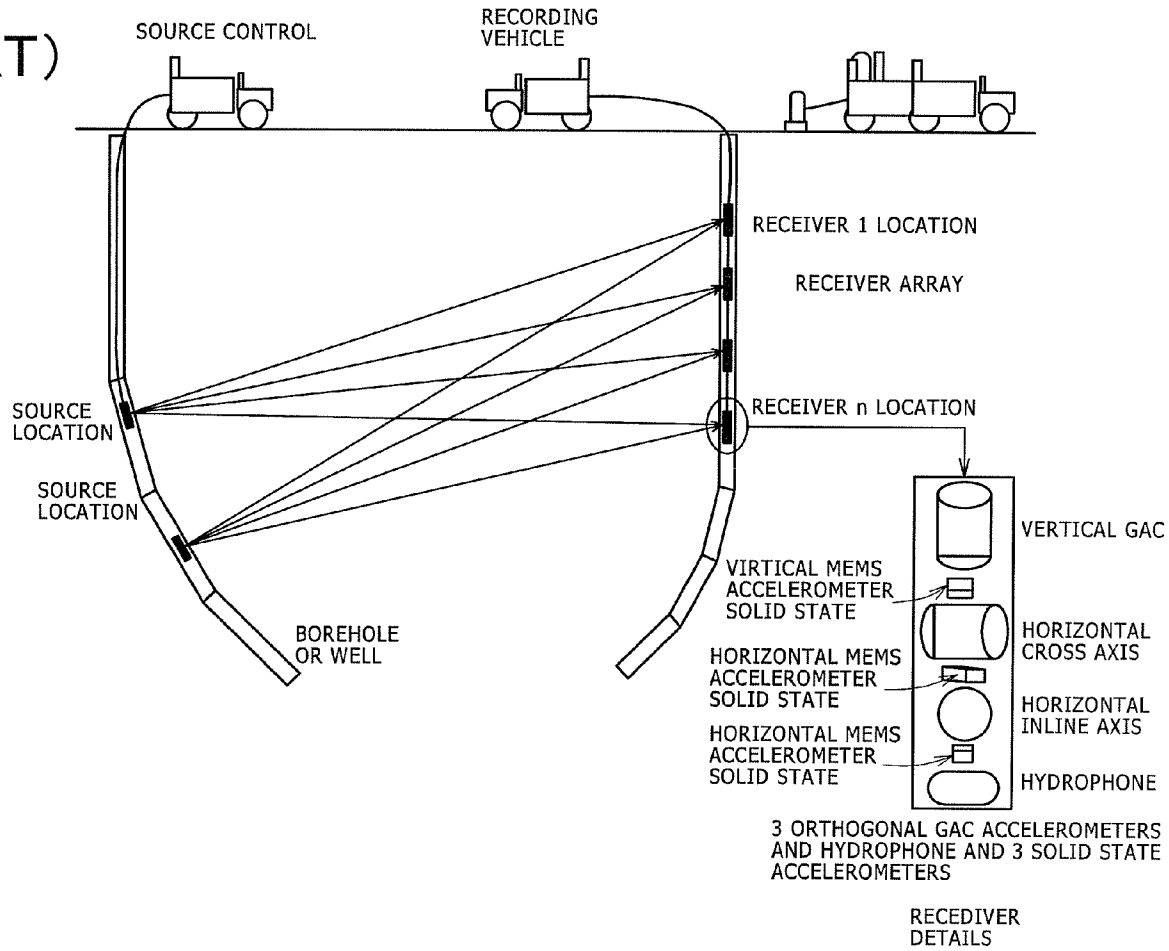
FIG. 7 (PRIOR ART)
FIG. 7 illustrates an exemplary system according to conventional borehole seismic sensing techniques.

The methods and systems described above may be implemented, for example, in a seismic surveying system such as shown in FIG. 7. Moreover, the techniques of the present disclosure may be utilized in a microseismic surveying system having a first and a second wellbore with the first wellbore traversing a formation with a zone that is scheduled for hydraulic fracture. The second wellbore may contain one or more, and in some aspects a plurality, of sensors according to the principles described herein. A communication cable such a telemetry wire facilitates communication between the sensors and a computer data acquisition and control system. Based on the waveforms received, computers, such as the computer data acquisition and control system, may run programs containing instructions, that, when executed, perform methods according to the principles described herein. Furthermore, the methods described herein may be fully automated and able to operate continuously in time for the purposes of the present disclosure.

For purposes of this disclosure, when any one of the terms wire line, cable line, slickline or coiled tubing or conveyance is used it is understood that any of the above-referenced deployment means, or any other suitable equivalent means, may be used with the present disclosure without departing from the spirit and scope of the present disclosure.

Figure 3:
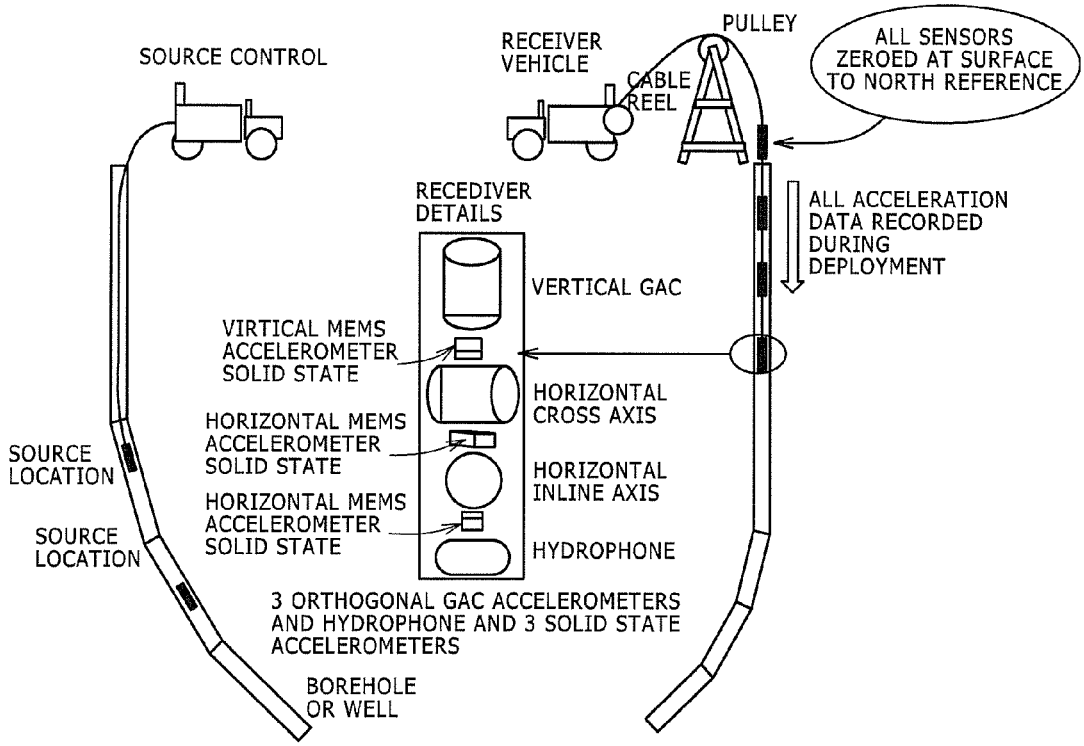
FIG. 3 illustrates an exemplary system according to one embodiment of the present disclosure.

As illustrated in FIG. 3, the present systems and methods can be utilized to record seismic data for conducting a seismic survey of subsurface formations. Aspects herein can also be utilized to control and monitor operations during production by monitoring seismic data from the various subsurface formations, regions, and zones. In the monitoring capacity, the disclosure herein can be utilized to optimize production of the well. The placement of the well bore can be strategically located based on known seismic survey data that may have been previously obtained. Optimal placement of the well bore is desired such that optimal recording of seismic data for the subsurface formations of interest can be obtained.

Once the well bore has been established, a wire line (cable line), a coiled tubing or other conveyance can be spooled to extend down through the well bore where the plurality of sensor arrays are positioned along the wire line. Also, note that the wire line with the seismic sensors attached thereto can be extended as the well bore is being established. The principles described herein can be either permanently deployed for continuous production well monitoring or can be temporarily deployed for performing a subsurface seismic survey and then retracted. Permanent deployments enable continuous monitoring of production well operations. Once the wire line and the plurality of sensor arrays are in position, seismic data can begin to be gathered. If production ceases at the well or for some other reason seismic monitoring is no longer required, the system can be retracted and reutilized elsewhere. Note that the exemplary systems presented herein to describe embodiments are for the purpose of illustration and ease of understanding the apparatus and methods. The illustrations shown and described herein should not be construed to be limiting in any way with respect to the scope of the claims.

The present disclosure proposes that an oilfield tool may comprise several elements or shuttles, each of which needs to transmit information to the surface. One example is a seismic tool which includes multiple levels i.e., shuttles, each of which records 3- or 4-axis seismic signals at a particular location. Several shuttles may be connected together at prearranged spacings to provide an in-well multipoint recording of seismic events.

During deployment of the receiver array (note again FIG. 3) multi-axis accelerometer data can also be acquired and processed to determine the tool position and well profile. As one possible receiver array the GAC accelerometer from Schlumberger may be utilized according to the principles disclosed herein. However, during deployment the receiver motions may be too extreme for the highly sensitive GAC accelerometers causing overdriving of the accelerometer sensors. Therefore, the present disclosure envisions that in addition to the high sensitivity GACs, acceleration waveform data from lower sensitivity solid state MEMS accelerometers can be combined to produce a combined acceleration waveform of suitable or desirable dynamic range. The acquired waveform data can be inverted to produce tool position, orientation and well profile.

Some of the above-described methods and apparatus have applicability for both performing borehole surveys for planning well bore drilling and production and for monitoring borehole data during actual well production. Such borehole surveys include borehole seismic surveys and such monitoring of borehole data includes temporary or permanent monitoring.

Figure 4:
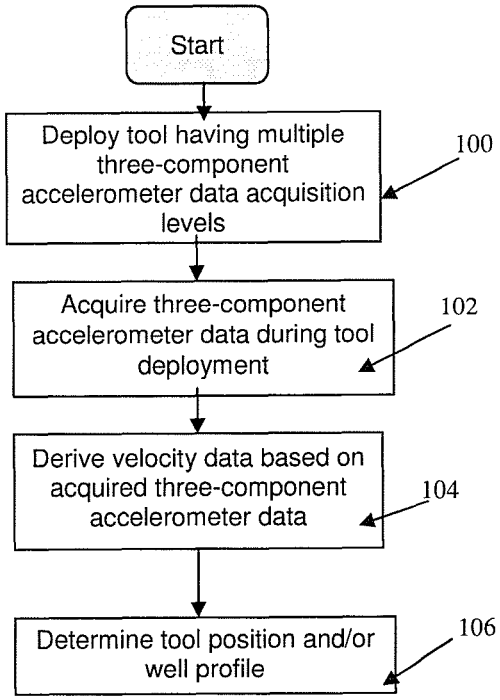
FIG. 4 is a flowchart depicting one embodiment of a method for determining tool position and/or well profile according to the present disclosure.

Referring to FIG. 4, a method of deriving tool position and/or orientation and/or well profile is depicted in a flowchart. The method involves deploying a tool having multiple three-component accelerometer data acquisition levels (Step 100). Three component accelerometer data is acquired during the tool deployment (Step 102). Velocity data based on acquired three-component accelerometer data is derived (Step 104). And then the tool position and/or well profile is determined.

Figure 5:
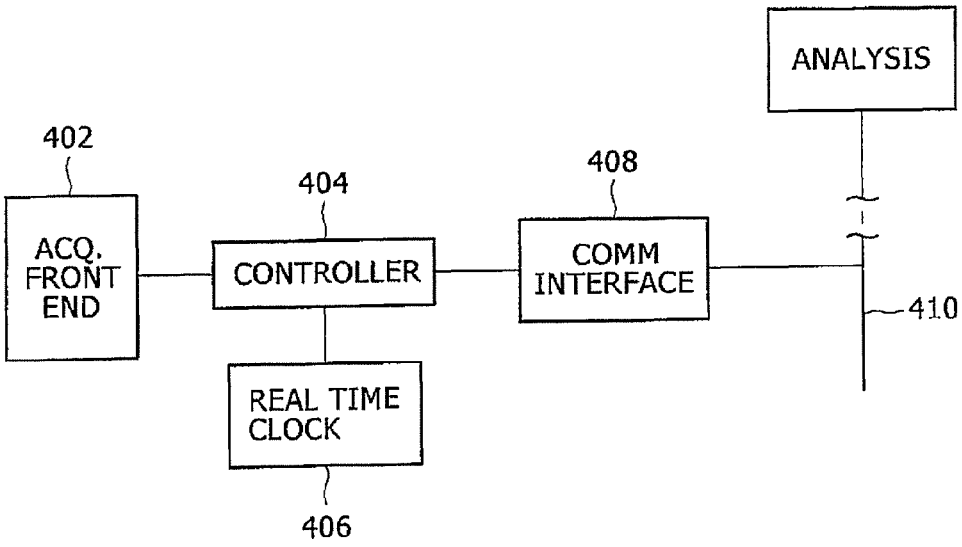
FIG. 5 is a schematic diagram of one possible apparatus for implementing the techniques of the present disclosure.

FIG. 5 shows one example of a system having a modular sensor section according to the principles discussed herein. The acquisition front end 402 may contain the sensor section elements described above, as well as their associated connections and electronics. For example, the acquisition section 402 may include electronics suitable for the relevant or desired frequencies that are to be received by the receiving device. In this, electronics for signal conditioning and digitization may be included as known to those of skill in the art. The overall operation of the system is coordinated by controller 404.

The controller is capable of adjusting the acquisition parameters for section 402 and timing the start and end of acquisition, among its other functions. A real time clock 406 may be used to provide the time to the controller for the determination of when a signal is received and for timing the appropriate collection intervals. Information from the controller may be sent to an analysis unit 412. In one embodiment, an analysis unit may be located at the surface of the borehole in platform 200 (note FIG. 2). Communications interface 408 may be used to convey the signals output from the controller 404 to the communication cable 410, and subsequently to analysis unit 412. The analysis unit may perform adaptive noise cancellation as well as determination of the acceleration and/or signal velocity for each data collection. As previously mentioned, the functions of the analysis unit may be distributed between modules at the surface and downhole, as desirable or necessary for the operations described herein.

The controller 404 and the surface analysis unit 412 are configured to measure the depth of the sensor section at any time. One method of accomplishing this is to measure the amount of conveyance that is output by the winch 16 (note FIG. 1). Knowing this depth, the acceleration waveform data can be acquired at a variety of depths. This allows the system to ensure that measurements are taken at specific depths and a complete well profile can be calculated even if the rig motion is temporarily stopped with the tool downhole.

Generally, the techniques disclosed herein may be implemented on software and/or hardware. For example, a computer may be provided in communication with the acoustic tool. A set of instructions, executable by the computer, may process the acoustic measurements and derive parameters relating to the tool position and orientation. In addition, the set of instructions may derive the well profile based on the acceleration measurements that are acquired during deployment of the tool. For example, the techniques described herein can be implemented in an operating system kernel, in a separate user process, in a library package bound into network applications, on a specially constructed machine, or on a network interface card. In one embodiment, the techniques disclosed herein may be implemented in software such as an operating system or in an application running on an operating system.

A software or software/hardware hybrid implementation of the present techniques may be implemented on a general-purpose programmable machine selectively activated or reconfigured by a computer program stored in memory. Such a programmable machine may be implemented on a general-purpose network host machine such as a personal computer or workstation. Further, the techniques disclosed herein may be at least partially implemented on a card (e.g., an interface card) for a network device or a general-purpose computing device.

Figure 6:
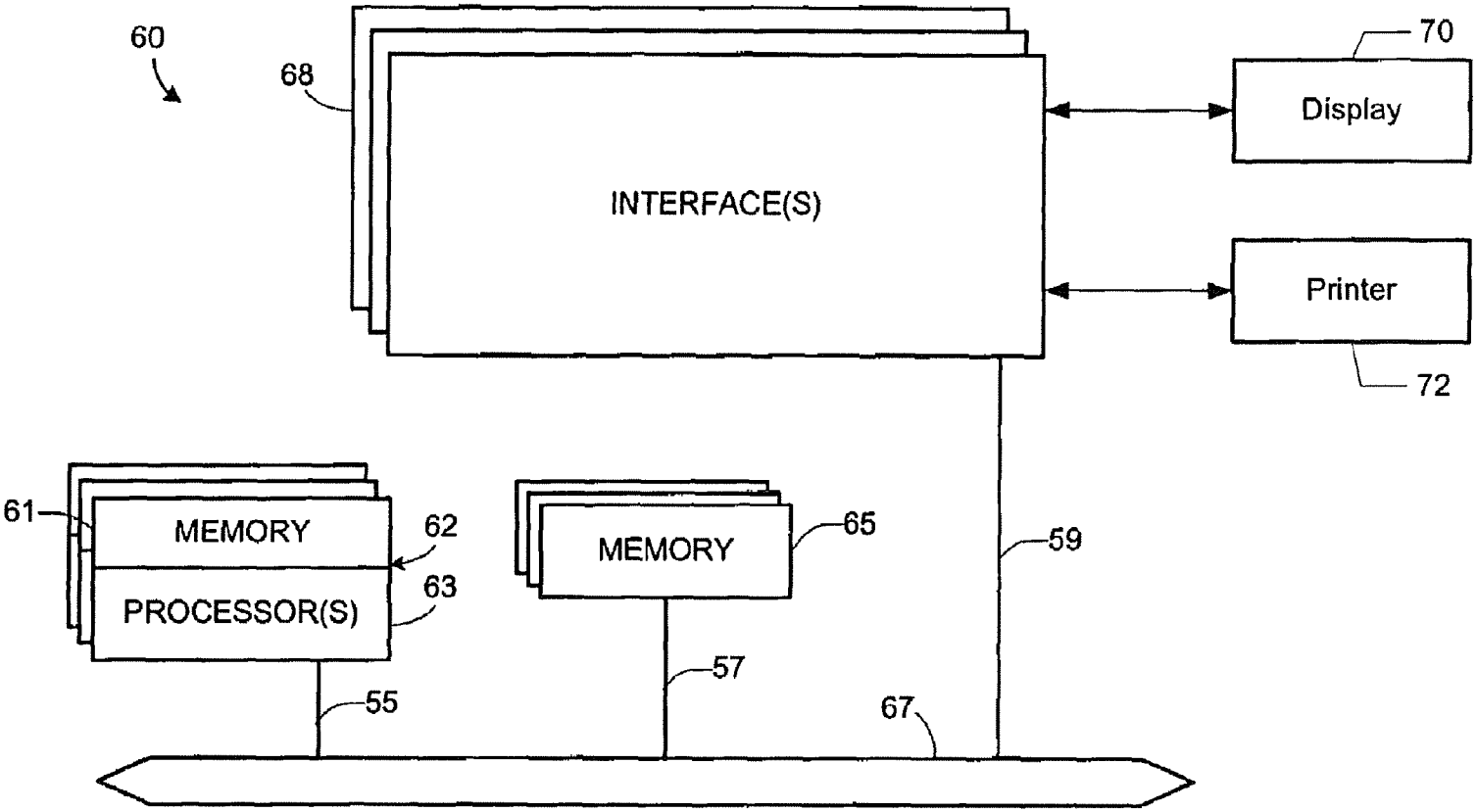
FIG. 6 is a schematic diagram of one possible system for implementing the techniques of the present disclosure.

Referring now to FIG. 6, a network device 60 suitable for implementing various aspects of the present techniques includes a master central processing unit (CPU) 62, interfaces 68, and a bus 67 (e.g., a PCI bus). When acting under the control of appropriate software or firmware, the CPU 62 may be responsible for implementing specific functions associated with the functions of a desired network device. For example, when configured as a general-purpose computing device, the CPU 62 may be responsible for data processing, media management, I/O communication, calculating velocity, tool position and orientation, calculating the well profile, etc. The CPU 62 preferably accomplishes all these functions under the control of software including an operating system (e.g. Windows XP), and any appropriate applications software.

CPU 62 may include one or more processors 63 such as a processor from the Motorola or Intel family of microprocessors, or the MIPS family of microprocessors. In an alternative embodiment, processor 63 is specially designed hardware for controlling the operations of network device 60. In another embodiment, a memory 61 (such as non-volatile RAM and/or ROM) also forms part of CPU 62. However, there are many different ways in which memory could be coupled to the system. Memory block 61 may be used for a variety of purposes such as, for example, caching and/or storing data, programming instructions, etc. The interfaces 68 are typically provided as interface cards (sometimes referred to as "line cards"). Generally, they control the sending and receiving of data packets over the network, and sometimes support other peripherals used with the network device 60, such as, for example, display devices 70 and/or printing devices 72. It will be appreciated that the various techniques of the present disclosure may generate data or other information to be presented for display on electronic display devices and/or non-electronic display devices (such as, for example, printed for display on paper).

Examples of other types of interfaces that may be provided are Ethernet interfaces, frame relay interfaces, cable interfaces, DSL interfaces, token ring interfaces, and the like. In addition, various very high-speed interfaces may be provided such as fast Ethernet interfaces, Gigabit Ethernet interfaces, ATM interfaces, HSSI interfaces, POS interfaces, FDDI interfaces and the like. Generally, these interfaces may include ports appropriate for communication with the appropriate media. In some cases, they may also include an independent processor and, in some instances, volatile RAM. The independent processors may be used, for example, to handle data processing tasks, display tasks, communication tasks, media control tasks, etc.

Although the system shown in FIG. 6 illustrates one specific network device, it is by no means the only network device architecture on which the present disclosure can be implemented. For example, an architecture having a single processor that handles communications as well as routing computations, etc. is often used. Further, other types of interfaces and media could also be used with the network device. Regardless of the network device's configuration, it may employ one or more memories or memory modules (such as, for example, memory block 65) configured to store data, program instructions for the general-purpose network operations and/or other information relating to the functionality of the techniques described herein. The program instructions may control the operation of an operating system and/or one or more applications, for example. The memory or memories may also be configured to store data structures, seismic logging information, acceleration information, prospecting information, and/or other specific non-program information described herein.

Because such information and program instructions may be employed to implement the systems/methods described herein, the present disclosure also relates to machine readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as optical disks; and hardware devices that are specially configured to store and perform program instructions, such as read-only memory devices (ROM) and random access memory (RAM). The present disclosure may also be embodied in a carrier wave traveling over an appropriate medium such as airwaves, optical lines, electric lines, etc. Examples of program instructions include both machine code, such as produced by a compiler, and files containing higher level code that may be executed by the computer using an interpreter.

The embodiments and aspects were chosen and described in order to best explain the principles of the disclosure and its practical applications. The preceding description is intended to enable others skilled in the art to best utilize the principles described herein in various embodiments and with various modifications as are suited to the particular use contemplated. It is intended that the scope of the present disclosure be defined by the following claims.

What is claimed is:

1. A system configured for acquiring accelerometer waveform data during deployment of a tool in a borehole, comprising:

a conveyance and at least one sensor section configured for deployment of the sensor section in a borehole;

the sensor section comprising:

at least one multi-axis receiver configured to detect acceleration waveform signals while the sensor section is being deployed in the borehole;

wherein the at least one multi-axis receiver comprises a first receiver array having a first sensitivity and a second receiver array having a sensitivity lower than the first receiver array.

2. The system of claim 1, further comprising:

a plurality of sensor sections, each sensor section comprising at least one multi-axis receiver configured to detect acceleration waveform signals while the sensor section is being deployed in the borehole.

3. The system of claim 2, wherein the system is configured or designed to acquire acceleration waveform signals from the plurality of sensor sections at multiple stations while the sensor sections are being deployed in the borehole.

4. The system of claim 2, wherein the system is further configured or designed to minimize noise while acquiring acceleration waveform signals during deployment of the sensor sections.

5. The system of claim 4, wherein the system is further configured or designed to control the speed of deployment to minimize noise while acquiring acceleration waveform signals during deployment of the sensor sections.

6. The system of claim 1, wherein the at least one multi-axis receiver comprises one or more three-component accelerometer.

7. The system of claim 1, wherein the at least one multi-axis receiver comprises three orthogonal geophones.

8. The system of claim 1, further comprising a processor configured for determining one or more of tool orientation, tool position and well profile.

9. The system of claim 1, further comprising:

a processor configured for combining first acceleration waveform signals and second acceleration waveform signals to acquire combined acceleration waveform data having a desired dynamic range.

10. The system of claim 1, wherein the system is configured for continuous acceleration waveform signal acquisition and processing.

11. The system of claim 1, further comprising:

a controller section operably connected to the sensor section and configured to adjust data acquisition parameters;

a clock operably connected to the controller section;

a communications interface operably connected to the controller and the conveyance and configured to communicate data along the conveyance;

a surface processing unit operably connected to the conveyance, wherein the at least one multi-axis receiver is configured to transmit electrical signals through the controller section, the communications interface, and the conveyance to the surface processing unit, and the surface processing unit is configured to perform signal processing and to generate acceleration and/or velocity data using the electrical signals from the at least one multi-axis receiver.

12. The system of claim 1, wherein the conveyance is configured to move the at least one sensor section through the borehole at a predetermined rate to minimize noise while acquiring acceleration waveform signals during deployment of the sensor section.

13. The system of claim 1, wherein the at least one multi-axis receiver comprises one or more three-component geophone and/or tetrahedron geophone.

14. The system of claim 1, further comprising a processor comprising instructions for signal processing.

15. An apparatus for acquiring acceleration waveform data while deploying a tool in a borehole, comprising:

at least one sensor section configured for deployment in a borehole;

the sensor section comprising:

at least one multi-axis receiver configured to detect acceleration waveform signals while the sensor section is being deployed in the borehole; and a processor configured for combining first acceleration waveform signals and second acceleration waveform signals to acquire combined acceleration waveform data having a desired dynamic range.

16. The apparatus of claim 15, wherein the at least one multi-axis receiver comprises at least one first three-component accelerometer and at least one second three-component accelerometer, wherein the first three-component accelerometer and the second three-component accelerometer have different sensitivity.

17. The system of claim 15, wherein the at least one multi-axis receiver comprises one or more three-component accelerometers.

18. The system of claim 15, wherein the at least one multi-axis receiver comprises three orthogonal geophones.

19. The system of claim 15, wherein the at least one multi-axis receiver comprises one or more three-component geophone and/or tetrahedron geophone.

20. A method for acquiring acceleration waveform data while deploying a tool in a borehole, comprising:

deploying at least one sensor section in a borehole, the sensor section comprising at least one multi-axis receiver;

acquiring acceleration waveform signals with the at least one multi-axis receiver while the sensor section is being deployed in the borehole; and combining first acceleration waveform signals and second acceleration waveform signals with a processor to acquire combined acceleration waveform data having a desired dynamic range.

* * * * *